US011165151B2

(12) United States Patent
Runyon

(10) Patent No.: US 11,165,151 B2
(45) **Date of Patent: *Nov. 2, 2021**

(54) TRUE TIME DELAY COMPENSATION IN WIDEBAND PHASED ARRAY FED REFLECTOR ANTENNA SYSTEMS

(71) Applicant: VIASAT, INC., Carlsbad, CA (US)

(72) Inventor: Donald L Runyon, Duluth, GA (US)

(73) Assignee: ViaSat, Inc., Carlsbad, CA (US)

( * ) Notice: Subject to any disclaimer, the term of this patent is extended or adjusted under 35 U.S.C. 154(b) by 56 days.

This patent is subject to a terminal disclaimer.

(21) Appl. No.: 16/403,439

(22) Filed: May 3, 2019

(65) Prior Publication Data

US 2019/0341690 A1 Nov. 7, 2019

Related U.S. Application Data

(63) Continuation of application No. 15/162,428, filed on May 23, 2016, now Pat. No. 10,333,218, which is a (Continued)

(51) Int. Cl.
*H01Q 3/22* (2006.01)
*H01Q 3/30* (2006.01)
(Continued)

(52) U.S. Cl.
CPC ..... *H01Q 3/30* (2013.01); *H01Q 1/288* (2013.01); *H01Q 19/17* (2013.01); *H01Q 3/2682* (2013.01); *H01Q 21/00* (2013.01)

(58) Field of Classification Search
CPC ..... H01Q 3/30; H01Q 3/2682; H01Q 1/288; H01Q 19/17; H01Q 21/00
(Continued)

(56) References Cited

U.S. PATENT DOCUMENTS 4,203,105 A * 5/1980 Dragone ..... H01Q 19/192 343/781 P
4,356,462 A 10/1982 Bowman
(Continued)

OTHER PUBLICATIONS

Runyon, "True Time Delay Compensation in Wideband Phased Array Fed Reflector Antenna Systems", U.S. Appl. No. 15/162,428, filed May 23, 2016.
(Continued)

*Primary Examiner* — Chuong P Nguyen
(74) *Attorney, Agent, or Firm* — Holland & Hart LLP

(57) ABSTRACT

Systems, devices, and methods for determining and applying true time delay (TTD) values for compensating for free-space path length differences between a phased array and a reflector in wideband communication are disclosed. TTD values are determined for individual and groups of antenna elements in phased array fed reflector (PAFR) antennas based distances from a focal region of the reflector. The distance from the focal region of the reflector and the offset of the phased array from the reflectors focal plane can be used to determine path length differences. Corresponding TTD values for antenna elements are then determined based on the path length difference associated with the antenna elements. Each antenna element can be coupled to a TTD element to provide the corresponding TTD value to the signals received by and generated by the antenna elements of the phased array. The TTD elements include transverse electromagnetic (TEM) mode mechanisms.

16 Claims, 7 Drawing Sheets

Related U.S. Application Data continuation of application No. 14/019,308, filed on Sep. 5, 2013, now Pat. No. 9,373,896.

(51) Int. Cl.

| | |
|---|---|
| ***H01Q 19/17*** | (2006.01) |
| ***H01Q 1/28*** | (2006.01) |
| *H01Q 3/26* | (2006.01) |
| *H01Q 21/00* | (2006.01) |

(58) Field of Classification Search
USPC ..... 342/375; 343/824
See application file for complete search history.

(56) References Cited

U.S. PATENT DOCUMENTS

| | | | | | |
|---|---|---|---|---|---|
| 4,882,588 | A * | 11/1989 | Renshaw | H01Q 3/22 | 342/373 |
| 5,134,417 | A | 7/1992 | Thompson | | |
| 5,202,700 | A | 4/1993 | Miller | | |
| 5,812,096 | A * | 9/1998 | Tilford | H01Q 19/17 | 343/776 |
| 5,936,588 | A | 8/1999 | Rao et al. | | |
| 5,936,592 | A | 8/1999 | Ramanujam et al. | | |
| 6,034,642 | A * | 3/2000 | Kojima | H01Q 3/20 | 343/753 |
| 6,295,395 | B1 * | 9/2001 | Paek | G02B 6/29311 | 343/720 |
| 6,392,611 | B1 | 5/2002 | Smith et al. | | |
| 6,456,252 | B1 | 9/2002 | Goyette | | |
| 6,999,044 | B2 | 2/2006 | Durham et al. | | |
| 7,075,495 | B2 | 7/2006 | Jung et al. | | |
| 7,227,501 | B2 * | 6/2007 | Lange | H01Q 19/12 | 343/700 MS |
| 7,231,111 | B2 | 6/2007 | Shibata | | |
| 7,710,340 | B2 * | 5/2010 | Rao | H01Q 19/12 | 343/781 R |
| 8,284,102 | B2 * | 10/2012 | Hayes | H01Q 25/00 | 342/374 |
| 8,354,956 | B2 | 1/2013 | Matyas et al. | | |
| 8,576,132 | B2 * | 11/2013 | Lier | H01Q 19/06 | 343/755 |
| 8,604,989 | B1 * | 12/2013 | Olsen | H01Q 25/008 | 343/754 |
| 8,810,468 | B2 | 8/2014 | Cannon et al. | | |
| 9,373,896 | B2 * | 6/2016 | Runyon | H01Q 3/30 | |
| 10,333,218 | B2 * | 6/2019 | Runyon | H01Q 3/30 | |
| 10,566,698 | B2 * | 2/2020 | Retter | H01Q 1/48 | |
| 10,777,903 | B2 * | 9/2020 | Basnev | H01Q 5/45 | |
| 2005/0237264 | A1 | 10/2005 | Durham et al. | | |
| 2007/0182654 | A1 | 8/2007 | Rao et al. | | |
| 2010/0117893 | A1 * | 5/2010 | Dreher | H01Q 21/0006 | 342/352 |
| 2011/0102263 | A1 | 5/2011 | Angeletti | | |
| 2012/0127034 | A1 * | 5/2012 | DiFonzo | H01Q 3/2682 | 342/375 |
| 2018/0013204 | A1 | 1/2018 | Burr et al. | | |
| 2020/0274611 | A1 * | 8/2020 | Mendelsohn | H01Q 1/288 | |

OTHER PUBLICATIONS

Runyon, "True Time Delay Compensation in Wideband Phased Array Fed Reflector Antenna Systems", U.S. Appl. No. 14/019,308, filed Sep. 5, 2013.

Lukasz A. Greda, et al.; "Beamforming Capabilities of Array-fed Reflector Antennas"; German Aerospace Center, Institute of Communications and Navigation, Wesling, Germany, 2011; 5 pgs.

Richard M. Davis, et al.; "A Scanning Reflector Using an Off-Axis Space-Fed Phased-Array Feed"; IEEE Transactions of Antennas and Propagation, vol. 39, No. 3; Mar. 1991; 10 pgs.

R. Lenormand, et al.; "A Versatile Array Fed Reflector Antenna for Satellite Communications"; ALCATEL ESPACE, Toul Ouse, France; 1998; 4 pgs.

H.K. Schuman, et al.; "A Phased Array Feed, Dual Offset Reflector Antenna for Testing Array Compensation Techniques"; Atlantic Research Corporation, Rome, NY; 1990; 4 pgs.

A. Kumar; "An Array Fed Dual Reflector Antenna at 36 GHz"; AK Electromagnetic, Inc., Quebec, Canada; 1989; 4 pgs.

V. Jamnejad; "Ka-band Feed Arrays for Spacecraft Reflector Antennas with Limited Scan Capability—An Overview"; Jet Propulsion Laboratory, Pasadena, CA; 1992, 10 pgs.

Dau-Chyrh Chang, et al.; "Pattern Synthesis of the Offset Reflector Antenna System with Less Complicated Phased Array Feed"; IEEE Transactions on Antenna and Propagation, vol. 42, No. 2; Feb. 1994; 6 pgs.

Dau-Chyrh Chang, et al.; "Sidelobes Cancellation in an Offset Reflector Antenna System Using a Linear Phased Array Feed"; Chung Shan Institute of Science and Technology, Taiwan, China; 1993; 4 pgs.

Kenji Ueno; "Multibeam Antenna Using a Phased Array Fed Reflector"; NTT Wireless Communication Systems Laboratories, Japan; 1997; 4 pgs.

Ken-Ichi Hariu, et al.; "Pattern Correction in Large Deployable Reflector Antennas with Phased Array Feed"; Advanced Space Communications Research Laboratory, Japan; 1997, 4 pgs.

Kenji Ueno; "Properties of a Large Scale Multibeam Antenna using a Phased Array Fed Reflector with Radially Aligned Elements"; NTT Wireless Systems Laboratories, Japan; 1999, 4 pgs.

Yutaka Imaizumi, et al.; "Closed-loop Beamforming Experiment for an Onboard Phased Array Fed Reflector Antenna"; NTT Network Innovation Laboratories, Japan; 2000, 4 pgs.

Kenneth W. Brown, et al., "Efficient Array-Fed Reflector Antenna"; Raytheon Systems Company, Rancho Cucamonga, CA; 2000, 4pgs.

Ziad A Hussein, et al.; "Partially Adaptive Phased Array Fed Cylindrical Reflector Technique for High Performance Synthetic Aperture Radar System"; Jet Propulsion Laboratory, Pasadena, CA; 2001, 4 pgs.

Tutaka Imaizumi et al.; "A Study on an Onboard Ka-band Phased-Array-Fed Imaging Reflector Antenna"; NTT Network Innovation Laboratories, NTT Corporation, Japan; 2002; 4 pgs.

Ming H. Chen, et al.; "A Dual-Reflector Optical Feed for Wide-Band Phased Arrays"; IEEE Transactions on Antennas and Propagation, vol. AP-22, No. 4; Jul. 1974; 5 pgs.

P.G. Smith et al., "Bandwidth Capability of Array-Fed Parabolic Cylinders"; IEEE Transactions on Antennas and Propagation, vol. Ap-30, No. 4; Jul. 1982; 5 pgs.

A.J. Fenn, et al.; "Analysis of an Adaptive Two-Reflector Phased-Array Fed System"; Martin Marietta Corp., Denver, CO; 1980; 4 pgs.

A.I. Zaghloul, et al.; "20-GHz Phased Array Fed Reflector Antennas with Distributed MMIC Modules"; COMSAT Laboratories, Clarksburg, MD; 1984; 4 pgs.

Yoshinori Suzuki, et al.; "Phased Array Fed Reflector Antennas with Interpolation Network for Next Generation Mobile Satellite Communication System"; NTT Network Innovation Laboratories, NTT Corporation, Japan; 2004; 4 pgs.

Susumu Nakazawa et al.; "Evaluation of Degradation of Shaped Radiation Pattern Caused by Excitation Coefficient Error for Onboard Array-Fed Reflector Antennas"; NHK Science & Technical Research Laboratory, Tokyo, Japan; 2004; 4 pgs.

Dr. Siegfried Voigt; "The German Heinrich Hertz Satellite Mission"; Satellite Communications, German Space Agency, Bonn, Germany; 2010; 4 pgs.

Michael Schneider, et al.; Test Results for the Multiple Spot Beam Antenna Project "Medusa"; Astrium GmbH; 2010; 4 pgs.

Randy L. Haupt; "Calibration of Cylindrical Reflector Antennas with Linear Phased Array Feeds"; IEEE Transactions on Antennas and Propagation, vol. 56, No. 2; Feb. 2008, 4 pgs.

Shoji Tanaka, et al.; "Onboard Array-Fed Reflector Antenna for 21-GHz-Band Direct Broadcasting Satellite"; NHK Science & Technical Research Laboratories, Tokyo, Japan; 2006; 8 pgs.

Freeman et al.; "SweepSAR: Beam-forming on Receive using a Reflector-Phased Array Feed Combination for Spaceborne SAR"; Jet Propulsion Laboratory, California Institute of Technology, Pasadena, CA; 2009; 9 pgs.

(56) References Cited

OTHER PUBLICATIONS

Mizzoni et al.; "Fee Systems for Array-fed Reflector Scansar Antennas"; Thales Alenia Space Italia, Rome, Italy; 2009; 5 pages.
Xie Ze-Ming, et al.; "An Improved Array Feed Parabolic Reflector Antenna for Spatial Power Combining"; School of Electronics and Information Engineering, South China University of Technology; 2009; 4 pages.
Hay; "Comparison of Single-ended and Differential Beamforming on the Efficiency of a Checkerboard Phased Array Feed in Offset and Front-Fed Reflectors"; CSIRO ICT Centre, Australia; 2010; 5 pages.
Malcolm Ng Mou Kehn, et al.; Performance of Multi-Beam Reflectors fed by Phased Array Feeds with Impedance-Matching Layers: Antennas and Propagation Society International Symposium (APSURSI); 2010; 4 pages.
Fujino, et al.: "Tradeoff Study on Array-Fed Reflector Antennas for 100-Beam-Class Multibeam Communication Satellite"; National Institute of Information and Communications Technology, Tokyo, Japan; 2010; 4 pages.
Chamberlain, et al.: "The DESDynl Synthetic Aperture Radar Array-Fed Reflector Antenna"; Jet Propulsion Laboratory, California Institute of Technology; 2010; 6 pages.
Marianna V. Ivashina, et al.; "An Optimal Beamforming Strategy for Wide-Field Surveys with Phased-Array-Fed Reflector Antennas"; IEEE Transactions on Antennas and Propagation, vol. 59, No. 6; Jun. 2011; 4 pages.
Xiaomeng Liu, et al.; "Synthesis Technique of Array-Fed Shaped-Reflector Antenna for DBF-SAR Application"; IEEE Antennas and Wireless Propagation Letters, vol. II; 2012; 4 pages.
A.V. Shishlov, et al.; "Active Array Fed Reflector Antennas, Practical Relations and Efficiency"; 6th European Conference on Antennas and Propagation; 2011; 5 pages.
O.A. Iupikov, et al.; "Towards the Understanding of the Interaction Effects Between Reflector Antennas and Phased Array Feeds"; International Conference on Electromagnetics in Advanced Applications; 2012; 4 pages.
Junichi Shinohara, et al.; "Measured Electrical Characteristics of an Array Feed Offset Parabolic Reflector Antenna"; Proceedings of International Symposium on Antennas and Propagation, Nagoya, Japan; 2012; 4 pages.
Andre Young, et al.; "Improving the Calibration Efficiency of an Array Fed Reflector Antenna through Constrained Beamforming"; IEEE Transactions on Antennas and Propagation, vol. 61, Issue 7; 2013; 9 pages.
Kyoko Tokunaga, et al.; "Design Optimization of Phased-Array-Fed Reflector Antennas for Mobile Communication Satellites"; Journal of Spacecraft and Rockets, vol. 36, No. 1; Jan.-Feb. 1999; 4 pages.
"Patch Excited Cup Element"; Mobile Communication; RUAG Aerospace Sweden; 2012; 2 pages.
Shoji Tanaka, et al.; "Onboard Array-Fed Reflector Antenna for 21-GHz-Band Direct Broadcasting Satellite"; NHK Science & Technology Research Laboratories, Tokyo, Japan; 2006; 8 pages.
Yoshi Nori Suzuki, et al.; "Phased Array Fed Reflector Antennas with Interpolation Network for Next Generation Mobile Satellite Communication Systems"; NTT Network Innovation Laboratories, NTT Corporation, Japan; 2004; 4 pages.
Kenji Ueno; "Multibeam Antenna Using a Phased Array Fed Reflector"; NTT Wireless Communication Systems Laboratories, Japan; 1997; 4 pages.
Kenji Ueno; "Properties of a Large Scale Multibeam Antenna Using a Phased Array Fed Reflector with Radially Aligned Elements"; NTT Wireless Systems Laboratories, Japan; 1999; 4 pages.
Matsumoto Yasushi, et al.; "3-6-3 Beam Forming Network"; Journal of the National institute of Information and Communications Technology, vol. 50, Nos. 3/4; 2003; 12 pages.
Yoshi Nori Suzuki, et al.; "Multibeam Phased Array Feed System Using Beam Group Concept"; NTT Access Network Systems Laboratories, Japan; Special Feature, vol. 5, No. 1; Jan. 2007; 9 pages.
Norbert Ratkorn, et al.; "MEDUSA—A Multiple Feeds per Beam Multi Spot Beam Antenna Project"; 2009; 4 pages.
Dr. Siegfried Voigt; "TWT's in space—Present Status and Future Applications"; Satellite Communications, German Space Agency, Bonn, Germany; 2009; 4 pages.
Yutaka Imaizumi, et al.; "Closed-Loop Beam Forming Experiment for an Onboard Phased Array Fed Reflector Antenna"; NTT Network Innovation Laboratories, Japan; 2000; 4 pages.
Yutaka Imaizumi, et al.; "A Study on an Onboard Ka-band Phased-Array-Fed Imaging Reflector Antenna"; NTT Network Innovation Laboratories, NTT Corporation, Japan; 2002; 4 pages.
K.K. Chan, et al.; "Confocal Parabolic Reflector Antenna Design Trade-Offs"; Antennas and Propagation Society International Symposium; 1993; 4 pages.
Alan Couchman, et al.; "Defocused Array Fed Reflector Antennas for Ka, Broad Band Satellites"; Ka and Broadband Communications Conference; 2010; 8 pages.
Yang-Su Kim, et al.; "Design and Measurements of Ka-band Waveguide Dielectric Rod Antenna for 7 Channel Digital Beamformer for HAPS"; Electronics and Telecommunications Research Institute; 2004; 4 pages.
S.A. Brunstein, et al.; "Characteristics of a Cigar Antenna"; JPL Quarterly Technical Review, vol. 1, No. 2; 1971; 9 pages.
Shoji Tanaka, et al.; "A Study on Pattern Synthesis Method for Array-Fed Reflector Antenna for Advanced Direct Broadcasting Satellites"; NHK Science & Technical Research Laboratories, Tokyo, Japan; 2001; 4 pages.
G. Caille, et al.; "High-Gain Multi beam Antenna Demonstrator for Ka-band Satellites"; Alcatel Telecommunications Review, 4th Quarter; 2001; 5 pages.
H. Chane, et al.; "Recent Developments in Feed Array for Ka-band FAFR Antenna"; European Conference on Antennas and Propagation; 2006; 2 pages.
Michael Schneider, et al.; The Multiple Spot Beam Antenna Project "Medusa"; European Conference on Antennas and Propagation; 2010; 4 pages.
Yann Cailloce, et al.; "Space Multi-Beam Antenna with Very High Figure of Merit, for Ka-band Multimedia via Satellite Transmission"; Alcatel Space Industries, France; 2012; 5 pages.
Skolnik, "Radar Handbook," 2nd Ed, 1990, pp. 7.61-7.63.

* cited by examiner

200

$i$ = # of antenna elements $$\tau \approx \Delta p = f_\tau(R, L) = \sqrt{L^2 + x^2 + y^2} - L$$

$\tau_1 = f_\tau(R1,L)$ $\tau_2 = f_\tau(R2,L)$ $\tau_3 = f_\tau(R3,L)$ $\tau_N = f_\tau(RN,L)$ $\tau_1 = f_\tau(Z1,L) = f_\tau([0,R1],L) = 0$ $\tau_2 = f_\tau(Z2,L) = f_\tau([R1,R2],L)$ $\tau_3 = f_\tau(Z3,L) = f_\tau([R2,R3],L)$ $\tau_N = f_\tau(ZN,L) = f_\tau([R(N-1),RN],L)$

TRUE TIME DELAY COMPENSATION IN WIDEBAND PHASED ARRAY FED REFLECTOR ANTENNA SYSTEMS

CROSS REFERENCE TO RELATED APPLICATIONS

This application is a continuation application and, pursuant to 35 U.S.C. § 120, is entitled to and claims the benefit of earlier filed application U.S. application Ser. No. 15/162,428 filed May 23, 2016, which is a continuation application of U.S. application Ser. No. 14/019,308 filed Sep. 5, 2013, the content of both of which are incorporated herein by reference in their entireties for all purposes.

BACKGROUND

The present invention relates to wireless communications, and in particular, to phased array fed reflector antennas systems for wideband communication.

Unless otherwise indicated herein, the approaches described in this section are not prior art to the claims in this application and are not admitted to be prior art by inclusion in this section.

Phased array antennas are capable of steering transmission and reception beams over a field of view. The ability of phased arrays to steer beams makes them suitable for relay communication systems in which multiple pathways between multiple locations are created (e.g., pathways between an internet service provider gateway and user terminals). The directivity of a phased array antenna is largely determined by the number of antenna elements in the phased array. The larger the directivity with which the beams can be steered allows for greater throughput because beams that might otherwise interfere with one another can be physically separated. Two beams with the same or overlapping carrier frequencies or polarizations can be directed toward two geographically isolated regions to avoid interference.

Adding a reflector, such as a parabolic reflector, to the phased array antenna can increase the directivity of the antenna without increasing the number of phased array elements. Phased array antennas configured with reflectors are often referred to as phased array fed reflector (PAFR) antennas. The increase in directivity afforded by PAFR antennas without the addition of significant size, weight and power consumption usually associated with additional antenna elements and the underlying beam forming hardware is particularly useful in size, weight, and power constrained devices and systems. For example, the payload and power capacities of satellites used in satellite communication systems are inherently limited. The directivity of a PAFR antenna in a satellite can provide for improved geographic separation of beams. The larger geographic separation of beams provides for increased frequency spectrum reuse and, therefore, increased throughput capacity.

SUMMARY

Embodiments of the present invention improve PAFR antenna systems for use in wideband communications. In particular, various embodiments address the coherence and timing issues associated with path length differences between reflectors and the various regions of the phased array. In one embodiment, the present disclosure includes a PAFR antenna system that includes a reflector having a focal region, a phased array of antenna elements comprising multiple antenna elements and disposed relative to the focal region of the reflector, multiple time delay compensation elements coupled to the antenna elements, that correspond to time delays associated with free-space path length differences between the phased array of antenna elements and the reflector. The phased array antenna system may also include multiple beam forming networks (BFN) coupled to the time delay compensation elements, where the plurality of beam forming networks are configured to provide signals to the plurality of antenna elements to generate one or more beams.

In another embodiment, the present disclosure includes a satellite that includes: a reflector having a focal region, a phased array of antenna elements that includes multiple antenna elements and is disposed relative to the focal region of the reflector, and a plurality of signal pathways. The signal pathways include multiple time delay compensation elements coupled to the antenna elements that correspond to time delay values associated with free-space path length differences between the array of antenna elements and the reflector. The beam forming networks are coupled to the plurality of time delay compensation elements and are configured to provide signals to the plurality of antenna elements to generate one or more beams.

In yet another embodiment, the present disclosure includes a system that includes: multiple terminals and a satellite. The satellite may include a reflector having a focal region and an array of antenna elements having multiple antenna elements. The reflector may be disposed relative to the focal region of the reflector. In some embodiments, the array is disposed between the focal point of the reflector and the reflector. The time delay compensation elements may be coupled to the antenna elements, and correspond to time delays associated with free-space path length differences between the array of antenna elements and the reflector. The satellite may also include multiple beam forming networks coupled to the time delay compensation elements. The beam forming networks are configured to provide signals to the antenna elements through the time delay compensation elements to generate one or more beams.

The following detailed description and accompanying drawings provide a better understanding of the nature and advantages of the present invention.

DETAILED DESCRIPTION

Figure 1:
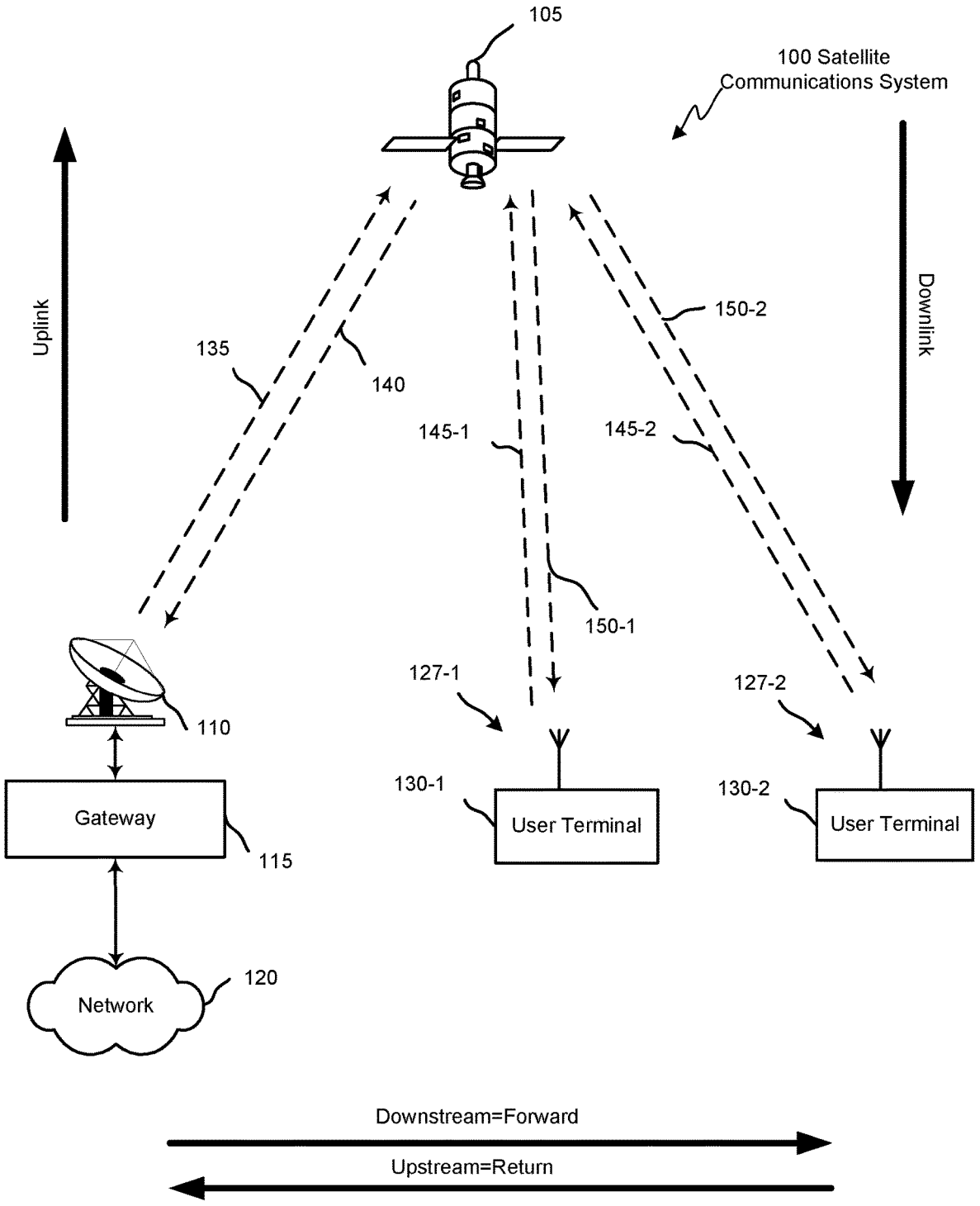
FIG. 1 is a block diagram of a satellite communication system that can be improved by various embodiments of the present disclosure.

Described herein are techniques for systems, devices, and methods for providing true time delay (TTD) to compensate for free-space path length differences in wideband PAFR antenna systems. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

Overview

Throughput capacity of PAFR antenna systems may be increased by increasing the width of the spectrum of frequencies with which the phased array illuminates the reflector. However, increasing the width of the frequency spectrum introduces additional complications.

PAFR antennas systems that generate beams with bandwidths greater than approximately 1.9 GHz can experience various coherence and timing issues associated with the beam steering phase shifters used in conventional PAFR antenna systems. Phase shifters are not true time delay devices and consequently are not frequency neutral and are typically most effective at a single center frequency. Accordingly, conventional PAFR antenna systems under and over steer frequencies in the band that are above and below the center frequency. The over and under steering effect is often referred to as "squint" and is present is phased arrays that employ phase shifters in wideband beam steering.

The squint of PAFR antenna systems can be mitigated by using frequency independent components, such as variable true time delay (TTD) circuits, to steer the beams. However, even in PAFR antenna systems that use frequency independent beam steering components suffer from secondary and tertiary coherence and timing issues rooted in the geometry of the PAFR antenna. Such secondary and tertiary coherence and timing issues impact the efficiency, efficacy, and throughput capacity of the PAFR antennas used in wideband communication systems (e.g., satellite communication systems). Throughput capacity and other limitations of PAFR antenna systems contribute to the difficulty satellite communication systems have when competing with other communication and data delivery methods (e.g., digital subscriber lines (DSL), cable, WiMax, etc.).

The present disclosure provides for systems, devices, and methods for PAFR antennas and PAFR antenna equipped communication systems with improved throughput capacity using wideband frequency spectra. Various techniques address the timing and coherence issues associated with the squint effect in wideband PAFR antenna systems that use frequency dependent beam steering components, such as phase shifters. Replacing the frequency dependent beam steering component with frequency independent components, such as TTD components will reduce the under and over steering of frequencies that are above and below the center frequency. Accordingly, replacing the phased array with a TTD array can reduce the squint effect in wideband directional array fed reflector antenna systems. However, even in TTD array fed reflector antenna systems, there are additional residual, yet significant, timing and coherence issues associated with the geometry of the array and the reflector. Previous efforts to correct timing and coherence issues in directional array fed reflector systems have not recognized these residual effects. However, such coherence and timing issues associated with the geometry of the array and the reflector are acknowledged by embodiments of the present disclosure as being significant limitations in the implementation of PAFR antenna systems in wideband communication system. In particular, embodiments of the present disclosure recognize the limitations imposed by the free space path length differences among the antenna elements of the array due to geometry of the reflector. Accordingly, embodiments include the determination and application of true time delays that compensate for corresponding differences in free-space path lengths between regions of the phased array and the reflector in wideband PAFR antenna systems.

As used herein, the term "antenna element" refers to an individual radiating element in an array of radiating elements. In transmit mode, each radiating element may radiate a constant or time varying electromagnetic field in response to signals received from one or more BFN. In receive mode, each radiating element may be configured with a gain characteristics in response to signals received from one or more BFN. In transmit mode, the term "beam" is used herein to refer to a constant or time varying directional emission of electromagnetic fields resulting from the individual antenna elements being driven by the corresponding BFN in a coordinated manner. For example, in the transmission mode of operation, each antenna element of a phased array may be driven, or phased, with a relative delay to emit individual modulated electromagnetic fields that interfere constructively and destructively to form a particular beam pattern. As such, so called transmit beams may include modulations of the frequencies or amplitude of the directional emission of electromagnetic fields that transmit one or more data or communication signals. In receive mode, the term "beam" may refer to the measure of directional gain of the array resulting from the individual antenna elements being configured according to signals from the corresponding BFN. As such, so called receive beams may refer to specific measures of directional dependence of antenna gain to modulations of the frequencies or amplitude of electromagnetic fields that carry one or more data or communication signals received from a particular direction. Accordingly, the terms transmit beam and receive beam may include signals that are sent in or received from a particular direction.

Each antenna element, or group of antenna elements, in a PAFR may be associated with a free-space path length between the phased array and the reflector. The free-space path lengths vary among the antenna elements due to the geometry of the reflector and the phased array. For systems in which the phased array is planar and centered on the focal axis of the reflector, the corresponding free-space path lengths are shorter for antenna elements located farther from the center of the phased array. To compensate for the differences in path lengths between the reflector and the various regions of antenna elements in the phased array, each antenna element can be coupled to a corresponding true time delay (TTD) element with a TTD value corresponding to a fixed free-space path length difference associated with the antenna element.

In some embodiments, the free-space path length difference for an antenna element can be determined based on a path length associated with that particular antenna element and a path length associated with one or more antenna elements disposed at or near the focal point or region of the reflector. The TTD value, and thus the type and configuration of the corresponding TTD element, for a particular antenna element may be customized based on its relative position to the focal region of the reflector. However, to reduce complexity and to simplify assembly by reducing the number of specialized parts within the PAFR antenna, the phased array may be divided into a number of zones corresponding to a range of distances from the focal region of the reflector. Each zone can be associated with a particular TTD value. Accordingly, each of the antenna elements within each of the zones can be coupled to a TTD element of a type and/or configuration to provide the appropriate TTD value that will compensate for the corresponding path length difference. In such embodiments, the TTD elements may be configured as any number of quantized TTD values. For example, a particular TTD element that provides a particular TTD value may include a particular length of coaxial cable or other transverse electromagnetic (TEM) mode device of a particular size, filter networks, or variable TTD circuits that include selectable multiple incremental value TTD elements. In such embodiments, the TTD elements, and their corresponding TTD values, may be fixed and independent of the variable weighting applied by the phased or dynamic TTD beam forming networks.

As used herein, the term "focal region" refers to the one, two, or three dimensional regions in front of a spherical or parabolic reflector in which the reflector will reflect electromagnetic energy received from a particular direction. For an ideal parabolic reflector, the focal region is a single point in the high frequency limit scenario. This is often referred to as the "geometric optics" focal point for the ideal parabolic reflector. In real world implementations, the surfaces of even the most advanced reflectors include errors, distortions, and deviations from the profile of the ideal surface. Uncorrelated errors, distortions, or deviations in the surface of a reflector of any significant size may cause a distribution of focal points in a two or three dimensional focal region. Similarly, in the case of a spherical reflector, in which the ideal surface results in a line of focal points instead of single focal point, errors, distortions, or deviations in the surface of real world spherical reflectors from the ideal spherical surface result in a three dimensional spread of the line focal region. In some embodiments, the focal region associated with the reflector is determined based on rays that are on-boresight, or parallel to the optical axis, of the reflector. In other embodiments, the focal region may be defined relative to a reference direction that is off-boresight of the reflector. A system of two or more reflectors may also be fed by a phased array with the system having a focal region.

A PAFR system with multiple reflectors sized and shaped appropriately can offer improved scanning performance over a wider field of view. For example, a multiple reflector PAFR system may have a main reflector and (in some examples smaller) subordinate reflectors. In other embodiments, two or more focal regions may be defined that are off-boresight of the reflector system. A bi-focal reflector system may be fed by a single phased array. A phased array fed single reflector or multiple reflector antenna system may include symmetric or offset geometry type reflector configurations. As used herein, the term "reflector" may refer to single or multiple reflector systems having various reflector shapes and profiles. In a multiple reflector system, the individual reflectors may include identical or varied reflector profiles and shapes.

Satellite Communication Systems

FIG. 1 is a diagram of an example satellite communications system 100 that may be improved by systems, methods, and devices of the present disclosure. Satellite communication system 100 includes a network 120 interfaced with one or more gateway terminals 115. Gateway terminal 115 is configured to communicate with one or more user terminals 130 via satellite 105. As used herein the term "communicate" refers to either transmitting or receiving (i.e. unidirectional communication) over a particular pathway.

Gateway terminal 115 is sometimes referred to herein as the hub or ground station. Gateway terminal 115 services uplink 135 and downlink 140 to and from satellite 105. Gateway terminal 115 may also schedule traffic to user terminals 130. Alternatively, the scheduling may be performed in other parts of satellite communication system 100. Although only one gateway terminal 115 is shown in FIG. 1 to avoid over complication of the drawing, embodiments of the present disclosure may be implemented in satellite communication systems having multiple gateway terminals 115, each of which may be coupled to each other and/or one or more networks 120. Even in wideband satellite communication systems, the available frequency spectrum is limited. Communication links between gateway terminal 115 and satellite 105 may use the same, overlapping, or different frequencies as communication links between satellite 105 and user terminals 130. Gateway terminal 115 may also be located remotely from user terminals 130 to enable frequency reuse. By separating the gateway terminal 115 and user terminals 130, spot beams with common frequency bands can be geographically separated to avoid interference.

Network 120 may be any type of network and can include for example, the Internet, an IP network, an intranet, a wide area network (WAN), a local area network (LAN), a virtual private network (VPN), a virtual LAN (VLAN), a fiber optic network, a cable network, a public switched telephone network (PSTN), a public switched data network (PSDN), a public land mobile network, and/or any other type of network supporting communications between devices as described herein. Network 120 may include both wired and wireless connections as well as optical links. Network 120 may connect gateway terminal 115 with other gateway terminals that may be in communication with satellite 105 or with other satellites.

Gateway terminal 115 may be provided as an interface between network 120 and satellite 105. Gateway terminal 115 may be configured to receive data and information directed to one or more user terminals 130. Gateway terminal 115 may format the data and information for delivery to respective terminals 130. Similarly gateway terminal 115 may be configured to receive signals from satellite 105 (e.g., from one or more user terminals 130) directed to a destination accessible via network 120. Gateway terminal 115 may also format the received signals for transmission on network 120. Gateway terminal 115 may use antenna 110 to transmit forward uplink signal 135 to satellite 105. In one embodiment, antenna 110 may comprise a reflector with high directivity in the direction of satellite 105 and low directivity in other directions. Antenna 110 may comprise a variety of alternative configurations include operating features such as high isolation between orthogonal polarizations, high-efficiency in the operational frequency band, low noise, and the like.

Satellite 105 may be a geostationary satellite that is configured to receive forward uplink signals 135 from the location of antenna 110. Satellite 105 may use, for example, a reflector antenna (e.g., a PAFR antenna), a direct phased array antenna, an antenna, or other mechanisms known in the art for reception of such signals. Satellite 105 may receive the signals 135 from gateway terminal 115 and forward corresponding downlink signals 150 to one or more of user terminals 130. The signals may be passed through a transmit reflector antenna (e.g., a PAFR antenna) to form the transmission radiation pattern (e.g., a spot beam). Satellite 105 may operate in multiple spot beam mode, transmitting and receiving a number of narrow beams directed to different regions on the earth. This allows for segregation of user terminals 130 into various narrow beams. Alternatively, the satellite 105 may operate in wide area coverage beam mode, transmitting one or more wide area coverage beams to multiple receiving user terminals 130 simultaneously.

Satellite 105 may be configured as a "bent pipe" or relay satellite. In this configuration, satellite 105 may perform frequency and polarization conversion of the received carrier signals before retransmission of the signals to their destination. A spot beam may use a single carrier, i.e. one frequency, or a contiguous frequency range per beam. In various embodiments, the spot or area coverage beams may use wideband frequency spectra. A variety of physical layer transmission modulation encoding techniques may be used by satellite 105 (e.g., adaptive coding and modulation).

Satellite communication system 100 may use a number of network architectures consisting of space and ground segments. The space segment may include one or more satellites 105 while the ground segment may include one or more user terminals 130, gateway terminals 115, network operation centers (NOCs) and satellite and gateway terminal command centers. The terminals may be connected by a mesh network, a star network, or the like as would be evident to those skilled in the art.

Forward downlink signals 150 may be transmitted from satellite 105 to one or more user terminals 130. User terminals 130 may receive downlink signals 150 using antennas 127. In one embodiment, antenna 127 and user terminal 130 together comprise a very small aperture terminal (VSAT), with antenna 127 measuring approximately 0.6 m in diameter and having approximately 2 W of power. In other embodiments, a variety of other types of antenna 127, including PAFR antennas, may be used as user terminals 130 to receive downlink signals 150 from satellite 105. Each of the user terminals 130 may comprise a single user terminal or, alternatively, may comprise a hub or router, not shown, that is coupled to multiple user terminals. Each user terminal 130 may be connected to various consumer electronics comprising, for example, computers, local area networks, Internet appliances, wireless networks, and the like.

In some embodiments, a multi-frequency time division multiple access (MF-TDMA) scheme is used for upstream links 140 and 145, allowing efficient streaming of traffic while maintaining flexibility and allocating capacity among each of the user terminals 130. In these embodiments, a number frequency channels are allocated statically or dynamically. A time division multiple access (TDMA) scheme may also be employed in each frequency channel. In this scheme, each frequency channel may be divided into several timeslots that can be assigned to a connection (i.e., a user terminal 130). In other embodiments, one or more of the upstream links 140, 145 may be configured using other schemes, such as frequency division multiple access (FDMA), orthogonal frequency division multiple access (OFDMA), code division multiple access (CDMA), or any number of hybrid or other schemes known in the art.

User terminal 130 may transmit data and information to a network 120 destination via satellite 105. User terminal 130 may transmit the signals by upstream link 145 to satellite 105 using antenna 127. User terminal 130 may transmit the signals according to various physical layer transmission modulation encoding techniques, including for example, those defined with the DVB-S2, WiMAX, LTE, and DOCSIS standards. In various embodiments, the physical layer techniques may be the same for each of the links 135, 140, 145, 150, or they may be different.

Satellite 105 may support non-processed, bent pipe architectures with PAFR antennas used to produce multiple small spot beam patterns. The satellite 105 can include J generic pathways, each of which can be allocated as a forward pathway or a return pathway at any instant of time. Large reflectors may be illuminated by a phased array providing the ability to make arbitrary spot and area coverage beam patterns within the constraints set by the size of the reflector and the number and placement of antenna elements. PAFR antennas may be employed for both receiving uplink signals 130, 140, or both and transmitting downlink signals 140, 150, or both. The beam forming networks (BFN) associated with the receive ($R_x$) and transmit ($T_x$) phased arrays may be dynamic, allowing for quick movement of the locations of both the $T_x$ and $R_x$ beams. The dynamic BFN may be used to quickly hop both $T_x$ and $R_x$ wideband beam positions.

Path Length Differences and True Time Delay Compensation Values

Various operational characteristics of a wideband PAFR antenna in satellite 105 become evident when transmitting wideband communications beams to user terminals 130-1 and 130-2. For example, if a wideband PAFR antenna equipped satellite 105 is in geostationary orbit somewhere above the Earth, and transmitting beams to and from the user terminals 130-1 and 130-2, various clusters of antenna elements are contributing to the formation of the beams. The free-space path lengths differences between the reflector and phased array result in some portion of the antenna elements in the clusters sending and receiving beams in a defocused state. Portions of a beam may thus appear to be received before other portions of the beam. Accordingly, a significant portion of the antenna elements and the corresponding beam forming hardware of the phased array are not effectively using the available wideband frequency spectrum. Various embodiments of the present disclosure can enable the use or increase the performance of wideband PAFR antenna systems.

Figure 2:
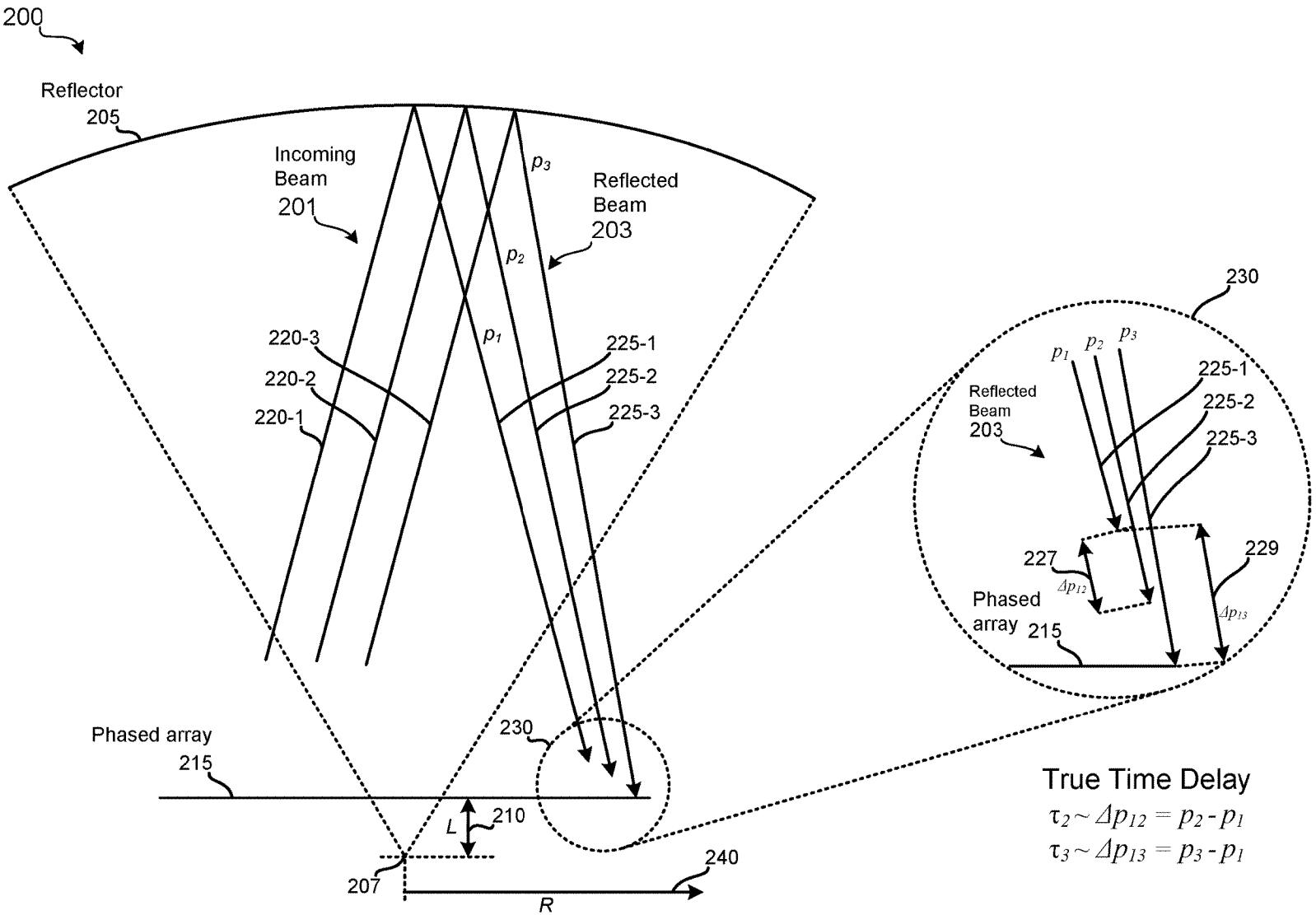
FIG. 2 illustrates path length differences in a PAFR antenna system in a receive mode of operation.

FIG. 2 is a schematic of a PAFR antenna system 200 in receiving mode of wideband communications. The PAFR antenna system 200 can receive incoming beams from a variety of angles. For example, the PAFR antenna system 200 may receive incoming beams that are parallel to or at an angle relative to the focal axis of the reflector 205. In some implementations the focal axis of the reflector 205 is the central axis about which the curvature of the reflector is symmetrical. Incoming beams that are parallel to the focal axis of the reflector 205 are referred to herein as on-boresight incoming beams, while incoming beams that are at an angle relative to the focal axis of the reflector 205 are referred to herein as off-boresight incoming beams. The performance of both wideband on-boresight and off-boresight beams are degraded by the differences in path lengths between the reflector and the phased array.

The example configuration shown in FIG. 2 illustrates a number of rays 220 of off-boresight incoming beam. The spacing and angles of incidence and reflection of the rays 220 are exaggerated for illustrative purposes. Because of the configuration and geometry of the reflector 205 and the phased array 215, portions of incoming beam 201 of a particular size, represented here by rays 220, will traverse differing free-space path lengths when reflected off the reflector 205 as reflected beam 203 and onto the phased array 215 that is offset from the focal region 207 by an offset L 210. The length of the reflected rays 225 illustrate the distance traveled by the individual rays within a given period of time. Accordingly, because the path length that ray 225-3 travels is shorter than the path lengths traveled by rays 225-1 and 225-2, it will be received by corresponding antenna elements of the phased array 215 before corresponding antenna elements of the phased array 215 receive rays 225-1 and 225-2. Region 230 is enlarged to illustrate the differences in path lengths. Even though the focal region 207 is illustrated as a single point, the focal region 207 may include a two or three dimensional distribution of intersecting rays. Accordingly, the offset L 210 can be determined relative to a center point in the focal region that is determined based on the geometry of the region and/or the distribution of the intersecting rays. For example, the center point of the focal region may be centered on the most densely populated region of the distribution of intersecting rays in the focal region.

As shown in the enlarged region 230, the difference in path length can be defined by the additional distance that a particular reflected ray 225 must travel to reach the corresponding antenna elements of the phased array 215 relative to the reflected portion or ray 225 that reaches the phased array 215 first. In the particular example shown, reflected ray 225-3 will be incident upon the phased array 215 before the other reflected rays 225 because the free-space path length it traverses is shorter than the free-space path lengths traversed by the other reflected rays 225. The path length $p_3$ between the reflector 205 and the phased array 215 for reflected ray 225-3 is shorter than reflected ray 225-1 by $\Delta p_{13}$. Similarly, the path length $p_2$ is shorter than reflected ray 225-1 by $\Delta p_{12}$. Using this notation, the differences in free-space path lengths between the reflector 205 and the phased array 215 for various portions of the incoming beam can be expressed relative to the longest path length traversed by portions of the reflected beam 203. Accordingly, the difference in free-space path lengths traversed by various portions of the reflected beam 203 can be compensated for by adding a TTD element that causes a corresponding TTD value r. For the example shown in FIG. 2, to compensate for the path length difference $\Delta p_{13}$ of $p_3$, a TTD element the causes a TTD value $\tau_3$ that corresponds to the time it take ray 225-3 to traverse a distance $\Delta p_{13}$ can be coupled to the one or more antenna elements upon which reflected ray 225-3 is incident. To compensate for the path length difference $\Delta p_{12}$ of $p_2$, a TTD elements the causes a TTD value $\tau_2$ that corresponds to the time it take ray 225-3 to traverse a distance $\Delta p_{12}$ can be coupled to the one or more antenna elements upon which reflected ray 225-2 is incident. As shown in FIG. 2, the path lengths between the phased array 215 and the reflector 205 increase with distance from the focal region of the reflector 205. Accordingly, in systems like system 200 in which the phased array 215 is centered on the focal axis of reflector 205, the magnitude of TTD compensation increases with the radius R 240. In some embodiments, no TTD need be added to the portion or rays of the reflected beam 203 (i.e., $\tau=0$) that are at or within the focal region of the reflector 205.

Figure 3:
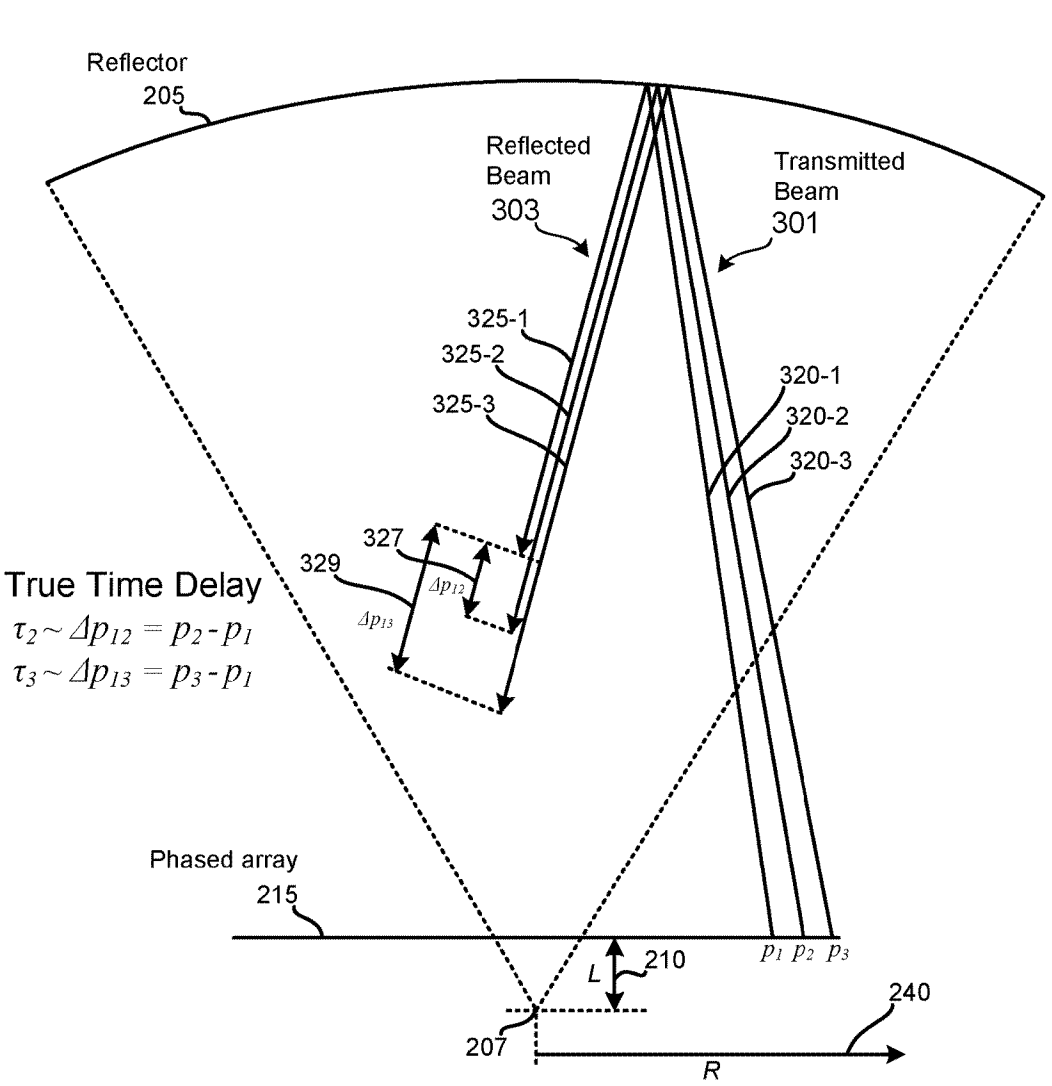
FIG. 3 illustrates path length differences in a PAFR antenna system in a send mode of operation.

FIG. 3 illustrates the PAFR antenna system 200 reflector 205 and the phased array 215 of FIG. 2 in a mode in which it is generating emitted beam 301 for wideband communications. The emitted beam 301 reflects off reflector 205 as reflected beam 303. Again, due to the configuration and geometry of the phased array 215 and reflector 205, the path lengths between the reflector 205 and the phased array 215 for portions of the reflected beam 203 will differ across the dimensions of the beam. The differences in free-space path lengths are illustrated in FIG. 3 by the differences in distances traversed by emitted rays 320 and the reflected rays 325 in a given period of time. The differences in the distances that the reflected rays 325 traverse are exaggerated for illustration purposes. As shown, because the free-space path length of path $p_3$ of emitted ray 320-3 is shorter than the free-space path length of path $p_1$ of emitted ray 320-1 by $\Delta p_{13}$, reflected ray 325-3 appears to reach a receiving antenna at a time $\tau_3$ before ray 325-1. Similarly, because the free-space path length of path $p_2$ of emitted ray 320-2 is shorter than the free-space path length of path $p_1$ of emitted ray 320-1 by $\Delta p_{12}$, reflected ray 325-2 appears to reach the receiving antenna at a time $\tau_2$ before ray 325-1. While only three path lengths are illustrated, one of ordinary skill in the art will realize that the differences in path lengths differ continuously along radius R 240.

Figure 4:
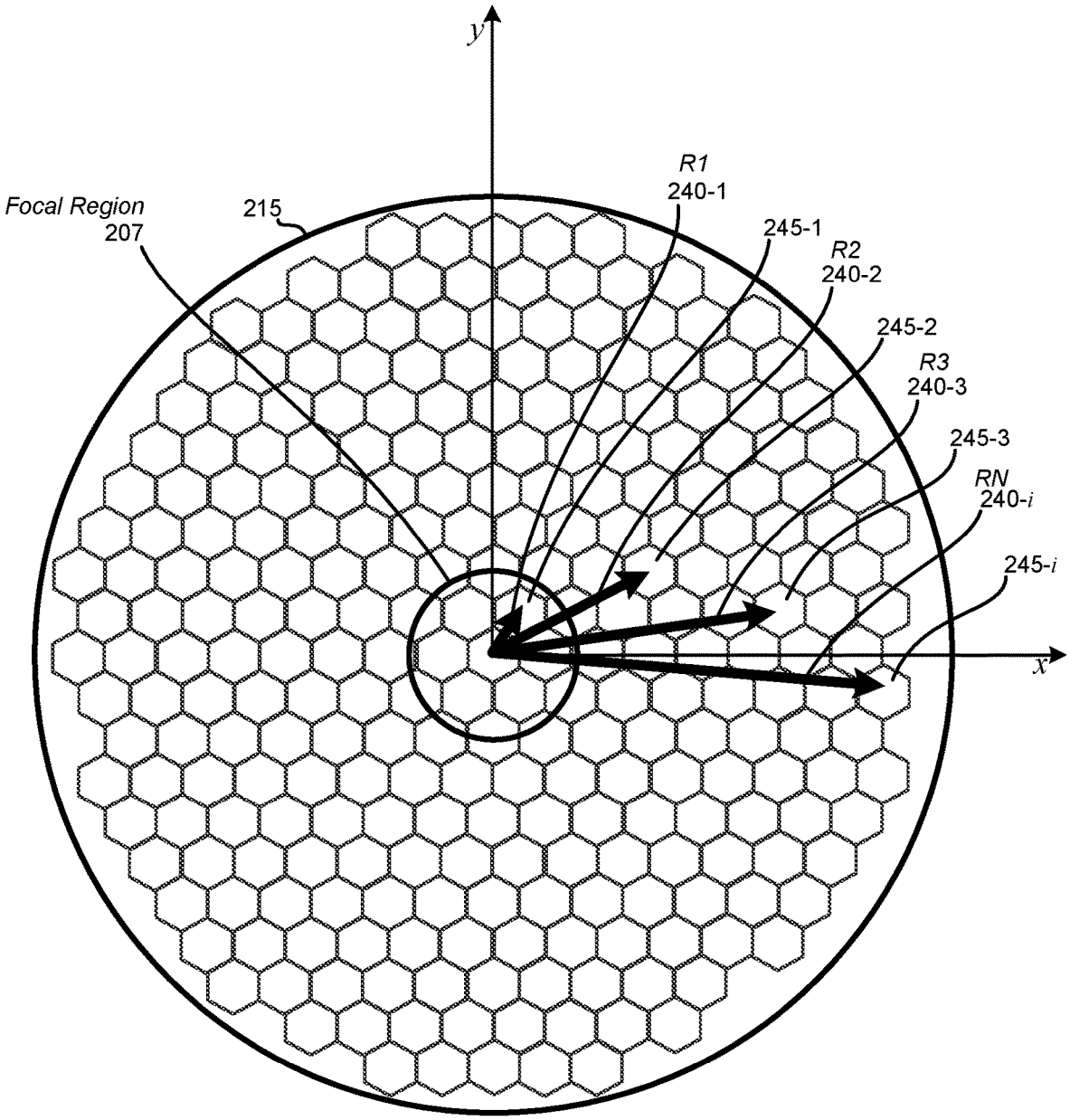
FIG. 4 illustrates the determination of path length differences based on the distance from a focal region, according to various embodiments of the present disclosure.

To compensate for the differences in time at which incoming beams 201 and reflected beam 303 are received by the phased array 215 or a user terminal 130 or gateway terminal 115, the free-space path length differences between the reflector 205 and the phased array 215 can be calculated as a function of a particular antenna element's or cluster of antenna elements' distance from the focal region 207 of the reflector 205 and the offset L 210. FIG. 4 shows the front surface of the phased array 215 that is positioned relative to a reflector 205 such that the focal region 207 is centered on the array of antenna elements 245. The necessary TTD value $\tau$ for a particular antenna element 245 corresponds to the time it take the relevant portion of the beam to traverse the path length difference between the reflector 205 and the phased array 215 associated with the particular sending/receiving antenna element 245. In one embodiment, the path length difference for a particular antenna element 245 can be based on the radius R 240 and offset from the focal point or plane of the reflector, L 210. Accordingly, the path length difference, and consequently, the TTD value $\tau$, may be determined by Equation 1.

$$\tau \approx \Delta p = f_\tau(R,L) = \sqrt{L^2+R^2} - L = \sqrt{L^2+x^2+y^2} - L \qquad \text{[Eq. 1]}$$

Where L is the offset of the front surface of the phased array 215 from the focal point of reflector 205, and (x,y) is the position of the corresponding antenna element 245 at a distance R from the focal region 207 in a Cartesian coordinate system having an origin defined at the center of the focal region 207. Thus, for a phased array 215 having i antenna elements 245, there are i−1 corresponding path length differences $\Delta p$ that need to be compensated with i corresponding TTD values $\tau$. In some embodiments, the $i^{th}$ path length differences $\Delta p$ and i corresponding TTD values $\tau$ are not unique. As used herein, i represents a natural number.

Antenna Element-Level Path Length Compensation

While FIG. 4 illustrates a phased array 215 having antenna elements 245 arranged in a close packed hexagonal pattern, often also referred to as an equilateral triangular lattice, the antenna elements 245 may also be arranged in various other configurations. For example, the antenna elements 245 may also be arranged in a triangular lattice that is not equilateral, or a square or rectangular lattice. Each configuration of antenna elements 245 has corresponding benefits. For example, the close packed equilateral triangular lattice shown in FIG. 4 is useful when generating beams in a circular field of view (FOV).

In some embodiments, the phased array 215 may be arranged in a planar configuration. However, embodiments of the present invention may also be applied to phased arrays that are either convex or concave relative to the curvature of the reflector 205. The differences in free-space path lengths may be determined using the corresponding geometry and arrangement of the given reflector and non-planar phased array. Additionally, the reflector 205, while described herein as being a parabolic, may have any spherical, aspherical, bi-focal, or offset shaped profile necessary for the generation of the desired transmission and receiving beams. Furthermore, antenna elements of the phased array 215 may also include enhanced directivity elements. Such enhanced directivity elements may include antenna element extensions that include various types of dielectric and metallic materials configured in various shapes, such as tubes, rods, cones, and the like. In some embodiments, the enhanced directivity elements of the antenna elements may include a combination of dielectric and metallic materials that incorporates various shapes and features.

Zonal Path Length Compensation

Figure 5:
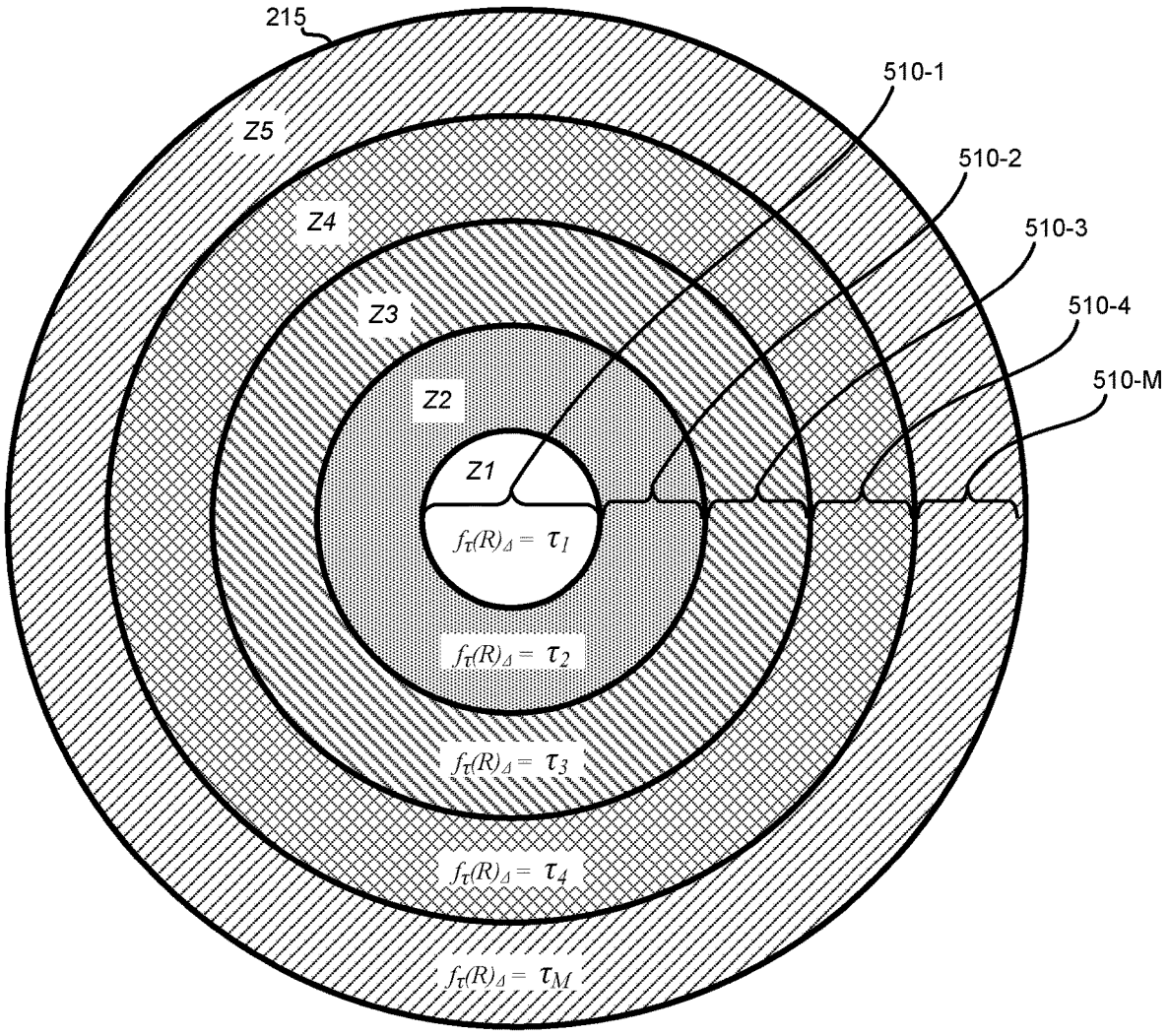
FIG. 5 illustrates the determination of path length differences based on zones of antenna elements, according to various embodiments of the present disclosure.

While some embodiments may include determining i antenna element-specific TTD values $\tau$, some other embodiments may include determining fewer than i TTD values $\tau$. In such embodiments, sufficient TTD compensation may be achieved by assigning predefined TTD values to the antenna elements 245 based on various ranges, or zones, of distances R 240 from the center of the focal region 207. FIG. 5 illustrates phased array 215 having a number of zones 510. In such embodiments, the corresponding TTD value $\tau$ for a particular antenna element can be based on or be a function of the zone 510 in which it is located. For example, antenna elements within the zones 510-2, 510-3, 510-4, and 510-M may be coupled to TTD components that contribute corresponding TTD values $\tau_2$, $\tau_3$, $\tau_4$, and $\tau_M$. While only five zones are illustrated, one of ordinary skill will recognize as many as M zones are possible, wherein M in a natural number.

In related embodiments, the TTD value $\tau$ applied to the antenna elements 245 within a particular zone 510 can be based on a statistical distance of the antenna elements 245 within that zone from the focal region 207. For example, the TTD value $\tau$ for a particular zone 510 may be based on the arithmetic mean, geometric mean, median, or other statistically relevant distance of the antenna elements 245 within the zones 510 from the focal region 207. In other embodiments, the TTD value $\tau$ for the antenna elements 240 within a particular zone 510 can be arbitrarily chosen or adjusted to optimize or fine-tune the transmission and reception characteristics of the beams generated by the phased array reflector fed antenna system 200.

System for Path Length Compensation

Figure 6:
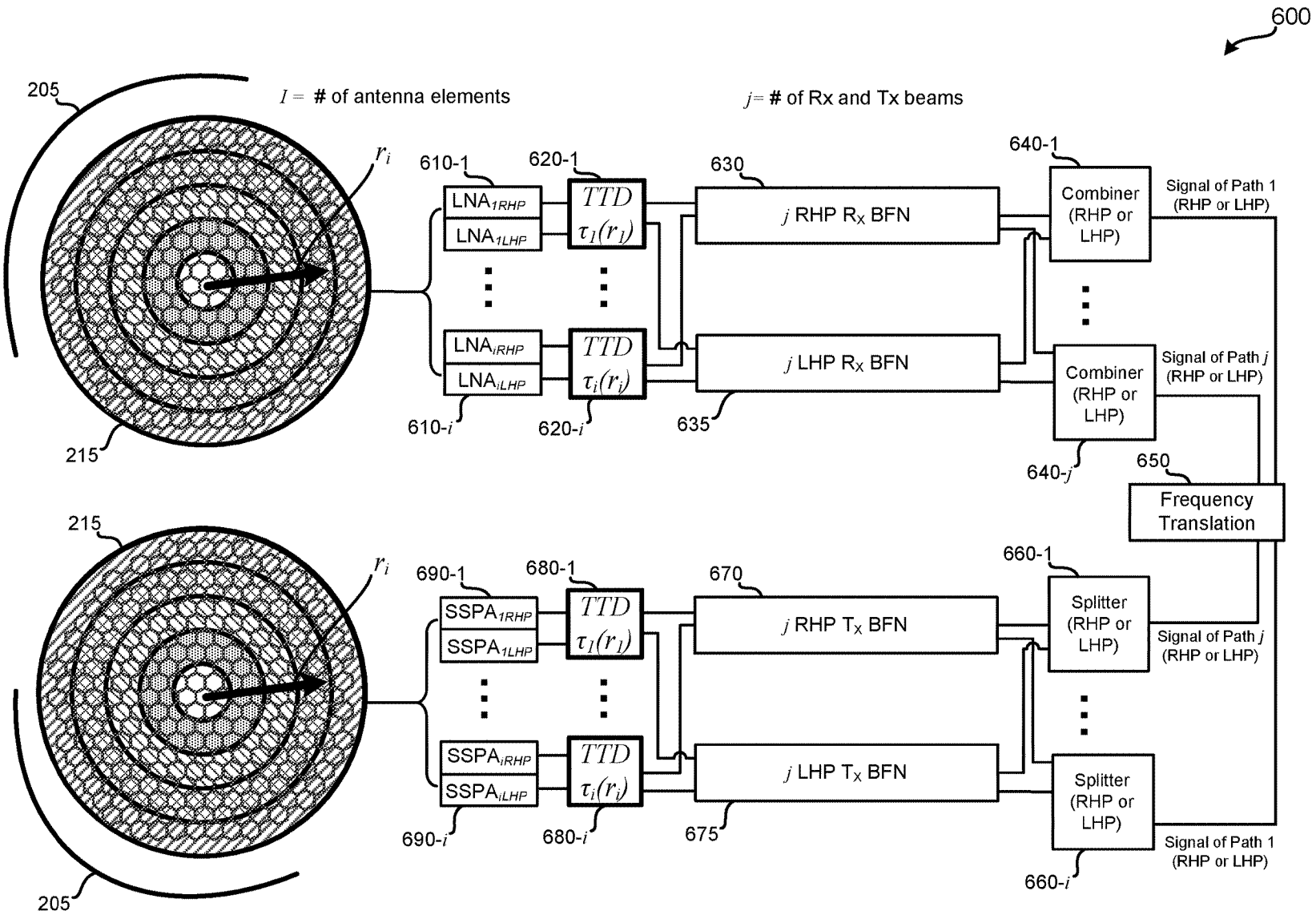
FIG. 6 is a block diagram of a system that includes true time delay compensation for path length differences between a reflector and a phased array.

FIG. 6 illustrates a system 600 that applies a corresponding individual or zonal TTD value $\tau_i(r_i)$ to each of the antenna elements in phased array 215 to compensate for the path length differences between the reflector 205 and the phased array. In the specific example shown in FIG. 6, the phased array 215 includes i antenna elements. In one embodiment, the i antenna elements may be coupled to corresponding low noise amplifiers (LNA) 610 and solid-state power amplifiers (SSPA) 690, for receiving and sending various numbers and types of incoming and transmitted beams. In the example shown in system 600, each one of the i antenna elements may be coupled to a right-hand polarization (RHP) LNA and a left-hand polarization (LHP) LNA to handle the RHP and LHP signals received by each corresponding antenna element. System 600 may also include RHP SSPAs and LHP SSPAs for amplifying the RHP and LHP transmission signals sent to the corresponding antenna elements. In such embodiments, each of the antenna elements may include a polarizer (e.g., a septum polarizer) for generating and transmitting corresponding polarized signals (e.g., orthogonal circularly polarized signals).

As discussed in reference to FIGS. 4 and 5, the TTD values $\tau_i(r_i)$ can be determined for each individual antenna element based on its distance $r_i$ from the focal region. In other embodiments, the TTD values $\tau_i(r_i)$ can be based on the inclusion of a particular antenna element with a zone having a range of distances from the focal region (e.g., Z1=[0,R1], Z2=[R1, R2], Z3=[R2, R3], etc.). In any of such embodiments, the application of the corresponding TTD values $\tau_i(r_i)$ may be achieved by coupling a time delay compensation element, such as TTD element 620, configured to provide the appropriate TTD values $\tau_i(r_i)$ to each of the antenna elements in the phased array 215. In one example embodiment, frequency independent time delay compensation elements, represented here as TTD elements 620 or 680, may include a particular length of coaxial cable that adds the prescribed value $\tau_i(r_i)$ of TTD to the signal received from or sent to the corresponding antenna element. In other embodiments, TTD elements 620 or 680 may include other types of transmission lines having TEM or quasi-TEM transmission characteristics, such as stripline devices, microstrip devices, and the like. In embodiments that use strip line or microstrip devices, the corresponding TTD elements 620 or 680 may include additional housing to prevent signal interference among the various components of the system 600. In one embodiment, the TTD elements 620 or 680 may include filter networks configured with combinations of electronic components including, but not limited to, inductors, capacitors, or resistors. The specific electronic components in a specific filter network can include corresponding component values and configurations to configure the filter network to impose a specific frequency independent time delay. In another embodiment, the time delay compensation elements represented in FIG. 6 as TTD elements 620 and 680, may include variable TTD circuits. Such variable TTD circuits can include multiple TTD elements of varying corresponding frequency independent time delays that can selectively be coupled to one another to provide a corresponding time delay. For example, variable TTD circuit may include a number of TTD elements coupled to one another in series by multiple corresponding switches. The switches can either bypass the corresponding TTD elements or couple them to one or more of the other TTD elements. In embodiments in which the phased array is replaced with a TTD array that uses variable TTD circuits to steer the beam, each beam steering variable TTD circuit for each antenna element may be biased with a TTD value $\tau_i(r_i)$ that compensates for the free space path length difference between the reflector and that antenna element. Independent of the type of TTD element implemented in a particular embodiment, the TTD values of the TTD elements used to compensate for the path length differences between the reflector and the array may be fixed and independent of the variable weighting applied by the corresponding phased or dynamic TTD beam forming networks of the antenna system.

In receiving mode, once the appropriate value $\tau_i(r_i)$ of TTD is applied to each of the signals coming from the corresponding antenna elements, the signals can be fed into RHP or LHP receiving BFN 630 and 635. The beam forming networks 630 and 635, while shown as being separate modules, may be contained in a singular beam forming network. Alternatively, system 600 may only receive only one polarization or non-polarized signals, and therefore may only include one or the other of the beam forming networks 630 or 635. The beam forming networks 630 and 635 may apply the appropriate weights to each of the TTD compensated signals to generate a number of beam forming signals that can be combined by combiners 640 into the j beams or pathways signals. In some communication systems in which the combiner 640 may be implemented (e.g., bent-pipe satellite communication systems), the received signals may be translated from one frequency to another using the frequency transition module 650 to avoid interference with transmitted beams generated by the same antenna elements of the phased array 215.

The frequency translated signals of the j pathways may then be sent to the splitters 660 coupled to frequency translation module 650. In some embodiments, the splitters 660 may split the incoming signals into a number of signals equal to the number of antenna elements in the phased array 215. Accordingly, in the particular example shown in FIG. 6, the splitters 660 may split the frequency translated signals received from the frequency translation module 650 into i identical signals. The RHP and LHP transmission BFN 670 and 675 coupled to the splitters 660 split signals and apply the appropriate weights to form the desired beams. Alternatively, system 600 may only transmit only one polarization or non-polarized signals, and therefore may only include one or the other of the beam forming networks 670 or 675. The weighted signals can then be sent through transmission TTD elements 680 to apply the corresponding value $\tau_i(r_i)$ of TTD for the signals sent to the corresponding antenna element via the SSPAs 690.

Method for Path Length Compensation

Figure 7:
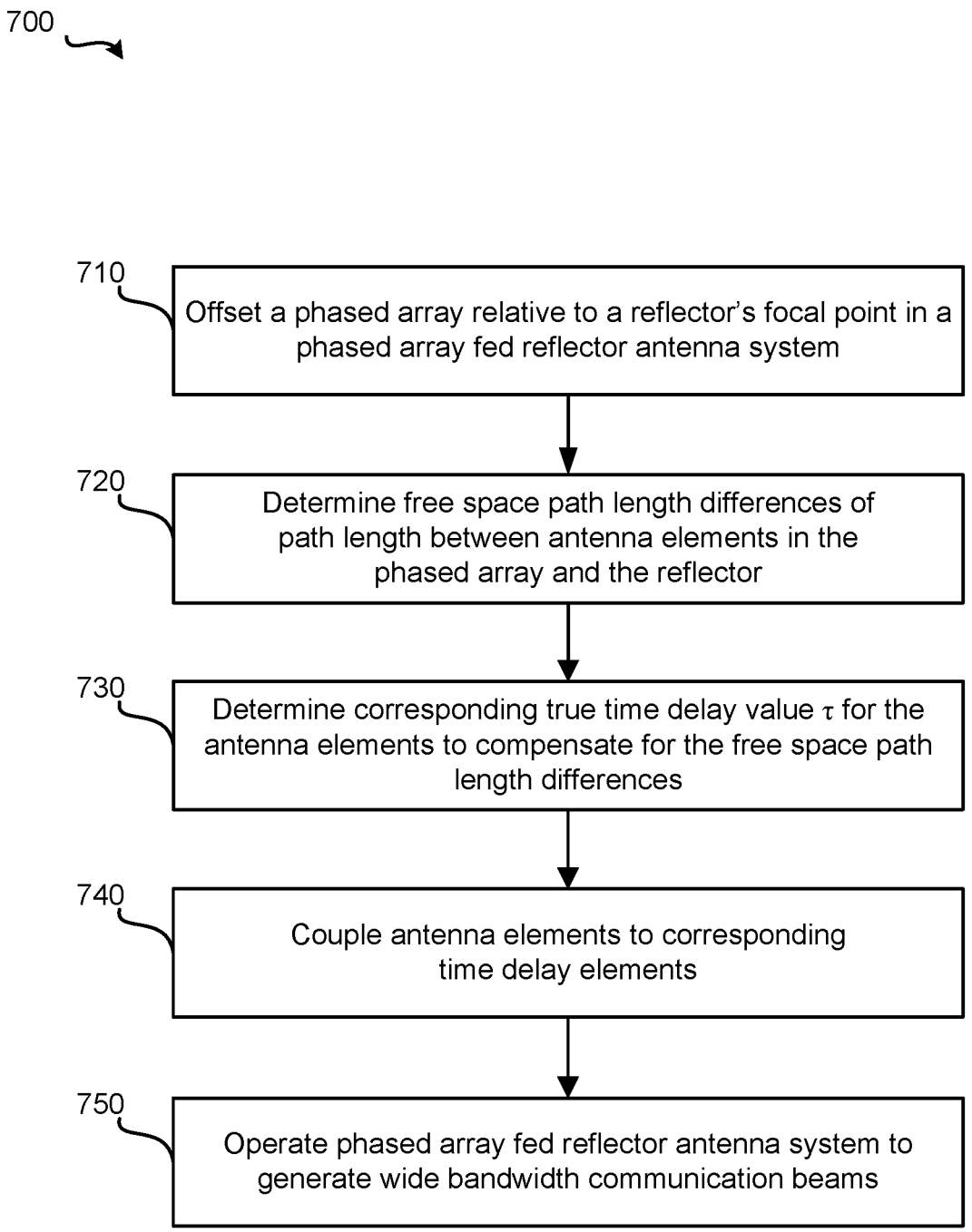
FIG. 7 is a flowchart of a method for determining and applying true time delay compensation for path length differences between the reflector and a phased array.

FIG. 7 is a flowchart of a method 700 for determining and applying $\tau_i(r_i)$ of TTD to the corresponding antenna elements to compensate for path length differences between a phased array 215 and reflector 205 of a PAFR antenna system for wideband communication. The method 700 may begin at action 710, in which a phased array is physically offset relative to the focal point of reflector 205. In such embodiments, the offset of the phased array can be determined based on the distance from the front surface of the phased array 215 relative to the focal point of the reflector 205. In such embodiments, offsetting the phased array 215 from the focal point of the reflector 205 results in a focal region 207 of antenna elements that are within some degree of focus. In this context, being in focus can refer to the associated path length differences being within an acceptable range. Antenna elements within the focal region 207 may be considered to be in focus such that no TTD compensation is necessary. Antenna elements outside of the focal region 207 may be defocused such that any received or transmitted wideband beams would not be coherent enough to enable wideband communication.

In action 720, the free-space path length differences between antenna elements in the phased array 215 and the reflector 205 may be determined. In one embodiment, the path length differences can be determined mathematically based on the distances of the individual antenna elements from the focal region 207. As discussed herein, the path length differences can be determined at the antenna element level or based on the zones of distances from the focal region 207.

In action 730, the corresponding TTD values $\tau$ can be determined for the corresponding antenna elements based on the corresponding path length differences. The TTD values $\tau$ may be determined at the antenna element level or be based on assigned predetermined TTD values $\tau$ for particular zones of antenna elements.

In action 740, the antenna elements may be coupled to TTD elements configured to provide the corresponding TTD values $\tau$. The TTD elements may include modular devices that employ various types of TEM mode TTD compensation. Accordingly, for embodiments that determine TTD values $\tau$ at the antenna element level, the TTD elements may include customized lengths of coaxial cable to provide the corresponding TTD. Alternatively, for embodiments that assign TTD values $\tau$ based on zones, the TTD elements may be configured in predetermined increments or quanta of TTD values $\tau$ to facilitate easy and organized assembly of the phased array fed antenna system with TTD compensated free-space path differences for wideband communications. Accordingly, the TTD values $\tau$ may be incremental or quantized time delay values. The number of zones can be based on the desired amount and granularity of path length difference compensation.

Once the antenna elements of the phased array 215 are coupled to the appropriate TTD elements, the PAFR antenna system can be operated using any number of BFN, combiners, splitters, filters, and amplifiers to generate and receive various numbers and types of beams and pathways for wideband communications, in action 750. The beam forming capabilities of various embodiments of the present disclosure may include, but is not limited to, spot beam patterns that take advantage of the full resolution capability of the PAFR antenna system, area coverage beams that approach the field of view (FOV) capability of the PAFR antenna system, and any combination thereof. In addition, satellite communication systems that incorporate various embodiments of the path length compensated PAFR antenna systems may include a number of pathways enabling multiple simultaneous transmit beams and multiple simultaneous receive beams. The pathway beams may have coverage characteristics of one or more spot beams, area coverage beams, a mix of spot and area coverage beams, as well as a number of spot beams or area coverage beams. For example, the pathway beam may include a number of spot beams having lower directivity of a single spot beam using the same pathway resources (i.e., BFN).

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

What is claimed is:

1. A phased array fed reflector (PAFR) antenna system comprising:

a reflector having a focal region;

a phased array comprising a plurality of antenna elements and disposed between the reflector and the focal region of the reflector; and a plurality of time delay compensation elements to communicate signals with the plurality of antenna elements, and corresponding to a plurality of time delays associated with a plurality of free-space path lengths between the phased array and the reflector.

2. The PAFR system of claim 1, wherein the plurality of time delay compensation elements are fixed time delay components.

3. The PAFR system of claim 2, further comprising a beam forming network coupled to the plurality of time delay compensation elements to apply weights to the signals and convert between the signals and beam forming signals, wherein the beam forming network is independent of the plurality of time delay compensation elements.

4. The PAFR system of claim 3, further comprising a network of combiner/splitters to convert between the beam forming signals and pathway signals.

5. The PAFR of claim 4, wherein the phased array has a first number of antenna elements, the pathway signals is a second number of signals, and the second number is different from the first number.

6. The PAFR of claim 5, wherein each of the pathway signals corresponds to a respective beam associated with the signals.

7. The PAFR of claim 3, further comprising a plurality of amplifiers to amplify the signals communicated between the plurality of time delay compensation elements and the plurality of antenna elements.

8. The PAFR of claim 1, wherein the plurality of time delay compensation elements is a first number of time delay compensation elements, the plurality of antenna elements is a second number of antenna elements, and the first number depends on the second number.

9. The PAFR of claim 1, wherein each of the plurality of antenna elements is coupled to a corresponding one of the plurality of time delay compensation elements.

10. The PAFR of claim 1, wherein the plurality of time delay compensation elements includes a first time delay compensation element corresponding to a first fixed time delay and coupled to a first antenna element of the plurality of antenna elements, and includes a second time delay compensation element corresponding to a second fixed time delay and coupled to a second antenna element of the plurality of antenna elements, wherein the first fixed time delay is different from the second fixed time delay.

11. The PAFR of claim 10, wherein the first fixed time delay is based on a first free-space path length between the first antenna element and the reflector, and the second fixed time delay is based on a second free-space path length between the second antenna element and the reflector.

12. The PAFR of claim 1, wherein the signals are receive signals received by the plurality of antenna elements, the plurality of time delay compensation elements is a first plurality of time delay compensation elements to apply first fixed time delay values to the receive signals to generate first compensated signals, and further comprising:

a receive beam forming network to apply weights to the first compensated signals to generate beam forming signals; and a plurality of combiners to combine the beam forming signals to generate a plurality of pathway signals.

13. The PAFR of claim 12, further comprising:

a frequency translation module to frequency translate the pathway signals;

a plurality of splitters to split the frequency translated pathway signals; and a transmit beam forming network to apply weights to the split frequency translated pathway signals to generate transmit signals; and a second plurality of time delay compensation elements to apply second fixed time delay values to the transmit signals to generate second compensated signals.

14. The PAFR of claim 13, wherein the plurality of antenna elements is a first plurality of antenna elements, and the phased array is a first phased array, and further comprising a second phased array comprising a second plurality of antenna elements to transmit the second compensated signals such that one or more transmit beams are generated.

15. The PAFR of claim 14, wherein the second plurality of antenna elements are disposed between the reflector and the focal region of the reflector.

16. The PAFR of claim 14, wherein the second plurality of antenna elements and the first plurality of antenna elements are the same.

* * * * *